US010455930B2

(12) United States Patent
Matsushita

(10) Patent No.: US 10,455,930 B2
(45) Date of Patent: Oct. 29, 2019

(54) COSMETIC DEVICE

(71) Applicant: MTG Co., Ltd., Nagoya, Aichi (JP)

(72) Inventor: Tsuyoshi Matsushita, Aichi (JP)

(73) Assignee: MTG CO., Ltd., Nagoya (JP)

( * ) Notice: Subject to any disclaimer, the term of this patent is extended or adjusted under 35 U.S.C. 154(b) by 127 days.

(21) Appl. No.: 15/562,641

(22) PCT Filed: Jun. 5, 2017

(86) PCT No.: PCT/JP2017/020819
§ 371 (c)(1),
(2) Date: Sep. 28, 2017

(87) PCT Pub. No.: WO2017/213081
PCT Pub. Date: Dec. 14, 2017

(65) Prior Publication Data

US 2018/0184794 A1 Jul. 5, 2018

(30) Foreign Application Priority Data

Jun. 7, 2016 (JP) ..... 2016-113824

(51) Int. Cl.

| | |
|---|---|
| ***A46B 13/02*** | (2006.01) |
| ***A45D 34/00*** | (2006.01) |
| ***A46B 13/00*** | (2006.01) |
| ***A45D 34/04*** | (2006.01) |

(52) U.S. Cl.
CPC ..... *A46B 13/023* (2013.01); *A45D 34/042* (2013.01); *A46B 13/008* (2013.01); *A46B 13/02* (2013.01); *A45D 2200/1063* (2013.01); *A45D 2200/207* (2013.01); *A46B 2200/102* (2013.01)

(58) Field of Classification Search
CPC ..... A46B 13/02; A46B 13/023; A46B 13/008; A45D 2200/207; A45D 2200/1063
See application file for complete search history.

(56) References Cited

U.S. PATENT DOCUMENTS

| | | | | |
|---|---|---|---|---|
| 8,185,992 | B2 * | 5/2012 | Linsbichler | A47L 11/06 15/28 |
| 10,159,386 | B2 * | 12/2018 | Hung | A47K 7/02 |
| 2006/0009719 | A1 * | 1/2006 | LaJoie | A45D 33/005 601/70 |

(Continued)

FOREIGN PATENT DOCUMENTS

| | | |
|---|---|---|
| JP | 2013-13601 | 1/2013 |
| JP | 5419280 | 11/2013 |

(Continued)

*Primary Examiner* — Randall E Chin
(74) *Attorney, Agent, or Firm* — DLA Piper LLP (US)

(57) ABSTRACT

A cosmetic device having a main body portion, and a brush portion disposed outside the main body portion, the cosmetic device including a vibration motor disposed in the main body portion and having a rotary shaft equipped with an eccentric weight; a motor holding portion that holds the vibration motor; a coupling portion disposed in the main body portion that connects the motor holding portion to the main body portion in a relatively displaceable state; and a brush attachment portion extending from the motor holding portion and connected to the brush portion, wherein the brush attachment portion extends in a direction different from an axial direction of the rotary shaft in the vibration motor.

16 Claims, 15 Drawing Sheets

(56) References Cited

U.S. PATENT DOCUMENTS

2006/0135891 A1* 6/2006 Jordan ..... A46B 13/008
601/20

FOREIGN PATENT DOCUMENTS

| | | | |
|---|---|---|---|
| JP | 2014-117496 | | 6/2014 |
| JP | 2015-213557 | | 12/2015 |
| WO | 2014/192307 | A1 | 12/2014 |
| WO | 2015/168076 | A1 | 11/2015 |

* cited by examiner

COSMETIC DEVICE

TECHNICAL FIELD

This disclosure relates to a cosmetic device.

BACKGROUND

A facial cleansing brush configured to be able to finely vibrate a brush tip may be used when cleansing the face for the purpose of removing dirt or the like adhering to the surface of the skin or in pores. As a vibrator driving device applied to this kind of facial cleansing brush, a vibrator driving device including a main body portion and a vibrator supported by the main body portion has been proposed (Japanese Unexamined Patent Application, First Publication No. 2015-213557). A vibration motor serving as a vibrating portion and a vibration transmission shaft to transmit vibrations generated by the vibrating portion to a brush main body serving as a vibrator are provided in the main body portion of this device. The vibrating portion and the vibration transmission shaft are fixed to an inner frame of the main body portion.

Although the usage and configuration are different from the facial cleansing brush, a technique of vibrating a brush has been proposed in the field of hairbrushes (Japanese Patent No. 5419280). The hairbrush of Japanese Patent No. 5419280 is designed to vibrate the brush bristle in a direction parallel to the scalp in order to improve easiness of loosening the hair.

However, the vibrator driving device of Japanese Unexamined Patent Application, First Publication No. 2015-213557 has two vibration motors, i.e., a first vibration motor that generates vibration about an axis parallel to a central axis of a main body case, and a second vibration motor that generates vibration about an axis orthogonal to the central axis. Therefore, there is a risk of causing problems such as an increase in the number of components and an increase in cost.

Further, in view of avoiding giving a user an unpleasant feeling, the hairbrush of Japanese Patent No. 5419280 proactively eliminates vibration of the brush in the direction in which the brush bristles are stretched. However, when that technique is applied to a facial cleansing brush as it is, it is difficult to efficiently remove dirt or the like in pores.

It could therefore be helpful to provide a cosmetic device capable of generating complex vibration with a single vibration motor and capable of efficiently removing dirt or the like of the skin.

SUMMARY

I thus provide:

A cosmetic device has a main body portion, and a brush portion disposed outside the main body portion, wherein the cosmetic device includes:

a vibration motor disposed in the main body portion and having a rotary shaft equipped with an eccentric weight;

a motor holding portion which holds the vibration motor;

a coupling portion which is disposed in the main body portion to connect the motor holding portion to the main body portion in a relatively displaceable state; and a brush attachment portion which extends from the motor holding portion and is connected to the brush portion, wherein the brush attachment portion extends in a direction different from an axial direction of the rotary shaft in the vibration motor.

In the cosmetic device, the vibration motor, the motor holding portion and the coupling portion are disposed in the main body portion. Further, the motor holding portion is coupled to the main body portion via the coupling portion in a relatively displaceable state. Therefore, the relative position of the motor holding portion with respect to the main body portion can be changed relatively freely, without being strongly restrained by the main body portion. Therefore, the cosmetic device can efficiently transmit the vibration of the vibration motor to the motor holding portion and the brush attachment portion extending from the motor holding portion.

Further, the brush attachment portion extends in a direction different from an axial direction of the rotary shaft in the vibration motor. Therefore, the vibration of the brush attachment portion applied by the vibration motor includes complex displacement obtained by combining displacement of the rotary shaft in the axial direction and displacement in an arbitrary direction orthogonal to the axial direction. Further, since the vibration is efficiently transmitted to the brush portion via the brush attachment portion, complex displacement obtained by combining displacement of the pores in the depth direction and displacement in an arbitrary direction orthogonal to this direction can be imparted to the brush tips of the brush portion. As a result, it is possible to efficiently remove dirt or the like adhering to the surface of the skin or in pores by the brush portion.

DETAILED DESCRIPTION

Figure 1:
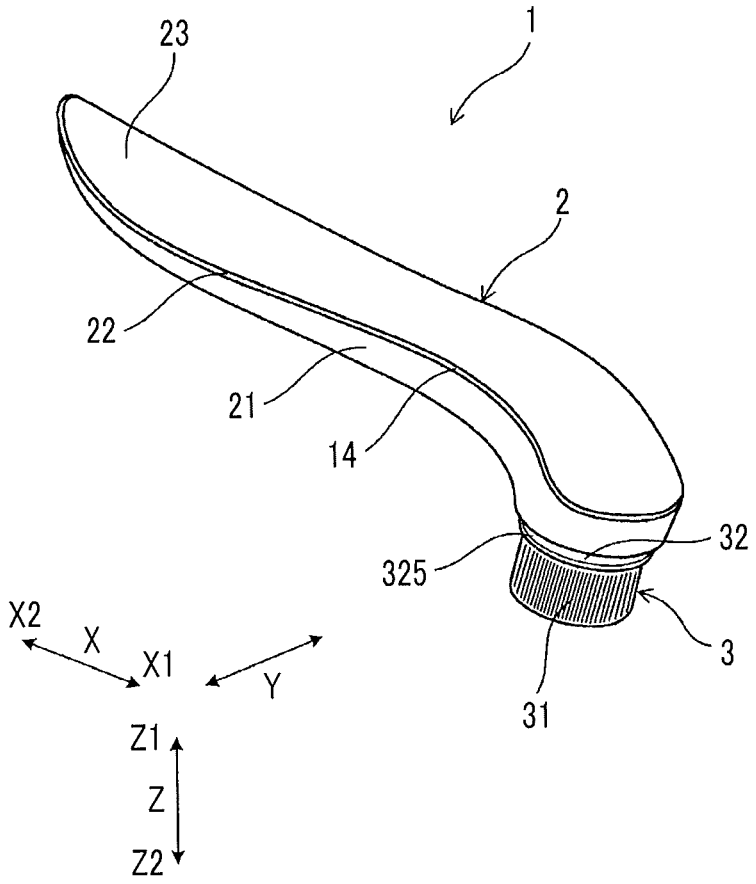
FIG. 1 is a perspective view of a cosmetic device in a first example.

In the cosmetic device, various structures can be adopted as the coupling portion. For example, the coupling portion has an engaging portion provided on one of the main body portion and the motor holding portion, and an engaged portion provided on the other thereof, and has a configuration in which the engaging portion and the engaged portion are engaged with each other in a relatively displaceable state.

More specifically, as the coupling portion, it is possible to adopt a configuration which includes a pin provided on one of the main body portion or the motor holding portion, and a ring provided on the other thereof. In this case, by providing an appropriate clearance between the pin and the ring, and by inserting the pin into the ring such that it is slidable with respect to the pin, the motor holding portion can be connected to the main body portion in a relatively displaceable state.

Further, as the coupling portion, it is also possible to adopt a so-called "snap-fit" structure which includes a protruding portion provided on one of the main body portion or the motor holding portion, and a recessed portion provided on the other thereof. In this case, by providing an appropriate clearance between the protruding portion and the recessed portion, and by storing the protruding portion in the recessed portion in a state in which there is play between the protruding portion and the recessed portion, the motor holding portion can be coupled to the main body portion in a relatively displaceable state.

The configuration of the coupling portion is not limited to the above-described example, and various configurations can be adopted as long as the motor holding portion can be relatively displaced with respect to the main body portion.

The coupling portion may have an elastic member interposed between the main body portion and the motor holding portion. In this case, when the vibration motor is vibrated, since the motor holding portion receives a repulsive force from the elastic member, the vibration can be efficiently transmitted by the brush attachment portion. As a result, it is possible to further increase the amplitude of the brush attachment portion, and it is possible to more efficiently remove the dirt adhering to the surface of the skin or in pores.

As the above-mentioned "elastic member," it is possible to adopt a member made of a material that can be easily elastically deformed with vibration generated from the vibration motor. Specifically, as the elastic member, it is possible to adopt members made of known elastomers such as natural rubber, synthetic rubber and thermoplastic elastomers, and known springs such as metal springs and resin springs.

Further, it is preferable that the elastic member be configured to be capable of resonating together with the vibration of the vibration motor. In this case, when the vibration motor is vibrated, the vibration can be efficiently transmitted by the brush attachment portion. As a result, it is possible to further increase the amplitude of the brush attachment portion, and it is possible to more efficiently remove the dirt adhering to the surface of the skin or in pores.

When the coupling portion has an elastic member, the coupling portion has a guide rod provided on one of the main body portion and the motor holding portion, and an elastic member held on the other thereof, and it is preferable for the guide rod to pass through the elastic member. In this case, the motor holding portion and the brush attachment portion continuous therewith can move relatively freely along the guide rod. As a result, it is possible to further increase the amplitude of the brush attachment portion, and it is possible to further increase the amplitude of the brush tip of the brush portion in that direction. Also, in this case, it is possible to more easily assemble the cosmetic device.

It is preferable for the brush attachment portion to extend in a direction perpendicular to the axial direction of the rotary shaft of the vibration motor. In this case, in the vibration of the brush attachment portion, the amplitude in an arbitrary direction orthogonal to the axial direction can be further increased. When this vibration is transmitted to the brush tip of the brush portion, the brush tip of the brush portion can be more greatly vibrated in the depth direction of the pores. Therefore, it is possible to more efficiently remove dirt or the like adhering to the insides of the pores.

Further, in this case, it is possible to suppress the amplitude in the axial center direction in the vibration of the brush attachment portion from excessively increasing. As a result, the friction between the brush tip of the brush portion and the surface of the skin can be further reduced.

The state in which "the brush attachment portion extends in a direction perpendicular to the axial center direction of the rotary shaft in the vibration motor" includes a state in which the extension direction of the brush attachment portion is a geometrically orthogonal direction with respect to the axial direction of the rotary shaft, and a state in which the extension direction of the brush attachment portion is slightly inclined from the geometrically orthogonal direction with respect to the axial center direction of the rotary shaft. More specifically, as long as an angle formed between the extension direction of the brush attachment portion and the axial center direction of the rotary shaft is 75 to 115°, the above-described operational effects can be sufficiently exhibited.

Further, as the angle Ruined by the extension direction of the brush attachment portion and the axial center direction of the rotary shaft comes closer to 90°, the amplitude of the brush in the depth direction of the pores can be increased. In view of this, the angle between the extension direction of the brush attachment portion and the axial center direction of the rotary shaft is preferably set to 80 to 110°, more preferably 85 to 95°, and further preferably 88 to 92°.

A brush portion is connected to the brush attachment portion. It is preferable that the brush portion have a large number of fibers extending along the extension direction of the brush attachment portion. In this case, it is possible to efficiently transmit the vibration of the brush attachment portion to the brush tip of the brush portion. As a result, it is possible to more efficiently remove dirt or the like adhering to the surface of the skin or in the pores.

The brush attachment portion may have a rotation restricting portion that restricts the rotational motion of the brush portion about the brush attachment portion. In this case, it is possible to prevent the skin from being scratched with the rotational motion of the brush portion. As a result, it is possible to further reduce irritation to the skin during use of the cosmetic device.

The cosmetic device may have a plurality of coupling portions. In this case, it is possible to reduce the load applied to one coupling portion due to the weight of the vibration motor or the motor holding portion. Therefore, the structure of the coupling portion can be made simpler, which makes it easier to reduce the weight of the cosmetic device.

When the cosmetic device has a plurality of coupling portions, some coupling portions among the plurality of coupling portions are disposed on one side in the axial direction of the rotary shaft with respect to the center of gravity of the vibration motor, and the remaining coupling portions are preferably disposed on the other side thereof. In this case, the displacement in the axial center direction and the displacement in the arbitrary direction orthogonal to the axial center direction in the vibration of the brush attachment portion can be increased in a well-balanced manner. As a result, it is possible to more efficiently remove dirt or the like adhering to the surface of the skin or in the pores.

The cosmetic device preferably has three coupling portions. In this case, the displacement in the axial center direction and the displacement in the arbitrary direction orthogonal to the axial center direction in the vibration of the brush attachment portion can be increased in a well-balanced manner. As a result, it is possible to more efficiently remove dirt or the like adhering to the surface of the skin or in the pores.

Further, when the cosmetic device has the three coupling portions, two of the coupling portions are preferably disposed on one side in the axial direction of the rotary shaft with respect to the center of gravity of the vibration motor, and the remaining one coupling portion is preferably disposed on the other side thereof. In this case, the displacement in the axial center direction and the displacement in the arbitrary direction orthogonal to the axial center direction in the vibration of the brush attachment portion can be increased in a well-balanced manner. As a result, it is possible to more efficiently remove dirt or the like adhering to the surface of the skin or in the pores.

As the vibration motor held by the motor holding portion, for example, it is possible to adopt a known vibration motor such as a cylinder type or a coin type. As the vibration motor, a cylinder type vibration motor is preferable. In this case, the displacement in the axial center direction and the displacement in the arbitrary direction orthogonal to the axial center direction in the vibration of the brush attachment portion can be increased in a well-balanced manner. As a result, it is possible to more efficiently remove dirt or the like adhering to the surface of the skin or in the pores.

The brush portion has a brush main body made of a large number of fibers, a brush holder for holding the brush main body, and a brush electrode disposed on the outer surface of the brush holder. The main body portion includes a current generating portion stored inside, and a main body electrode disposed on the outer surface. The brush electrode and the main body electrode may be electrically connected to each other via the current generating portion.

In the cosmetic device thus configured, the user grasps the main body electrode and interposes a liquid or foam-like cleaning agent having conductivity between the brush electrode and the skin. Thus, it is possible to form a closed circuit which includes the user, the brush electrode, the current generating portion, and the main body electrode. Further, by allowing a weak current to flow through the closed circuit, it is possible to obtain effects such as easier removal of impurities having electric charge from the skin, or infiltration of the charged cosmetic component into the skin.

For example, impurities adhering to the skin often have a negative charge. Therefore, by allowing a weak current to flow through the closed circuit so that the brush electrode serves as a positive electrode and the main body electrode serves as a negative electrode, it is possible to more easily remove the impurities and the like.

Further, when the detergent contains a charged cosmetic ingredient, by allowing a weak current to flow through the closed circuit such that the cosmetic ingredient infiltrates the skin, it is possible to promote infiltration of the cosmetic ingredient into the skin. For example, cosmetic ingredients such as vitamin C derivatives are negatively charged by ionizing. Therefore, by allowing a weak current to flow through the closed circuit such that the brush electrode serves as the negative electrode and the main body electrode serves as the positive electrode, it is possible to further promote infiltration into the skin.

The main body portion of the cosmetic device has a rod shape, and the vibration motor and the motor holding portion may be stored at the end portion of the main body portion in the longitudinal direction. In this case, the user can easily grasp the main body portion. As a result, usability of the cosmetic device can be further improved.

Further, the brush portion may be disposed on the side peripheral surface of the main body portion. In this case, the user can easily bring the brush tip of the brush portion into contact with the skin. As a result, usability of the cosmetic device can be further improved.

EXAMPLES

First Example

Figure 2:
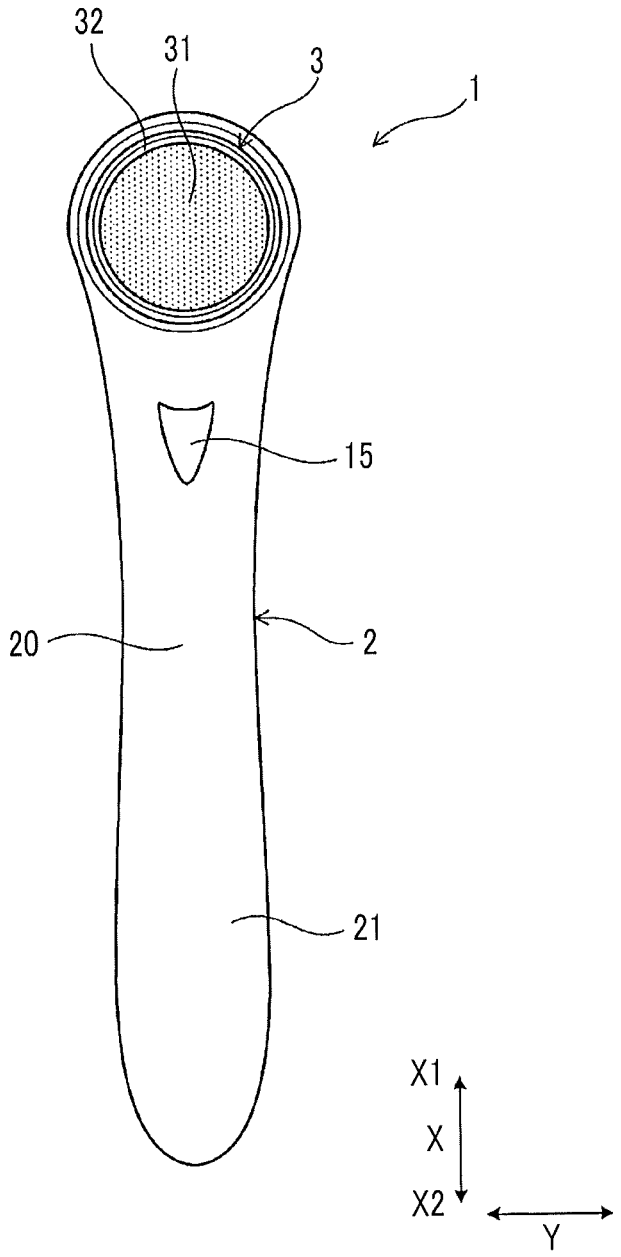
FIG. 2 is a bottom view of the cosmetic device in the first example.
Figure 3:
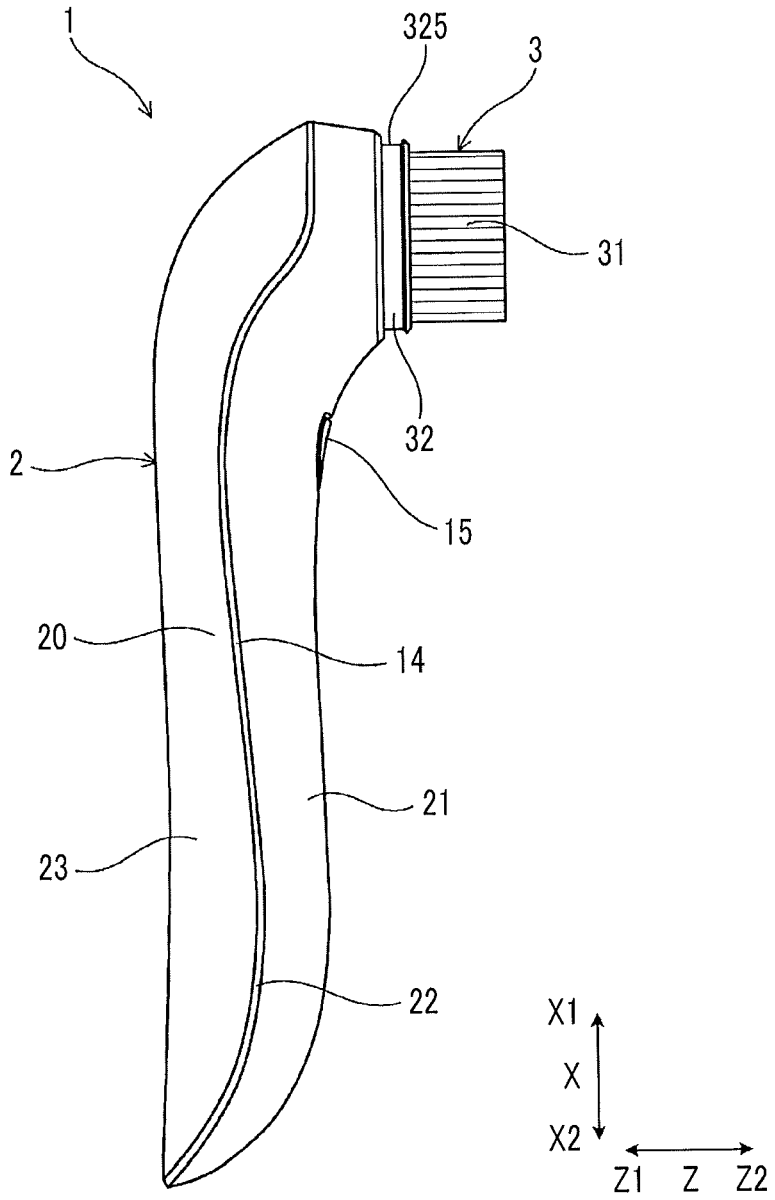
FIG. 3 is a side view of the cosmetic device in the first example.
Figure 6:
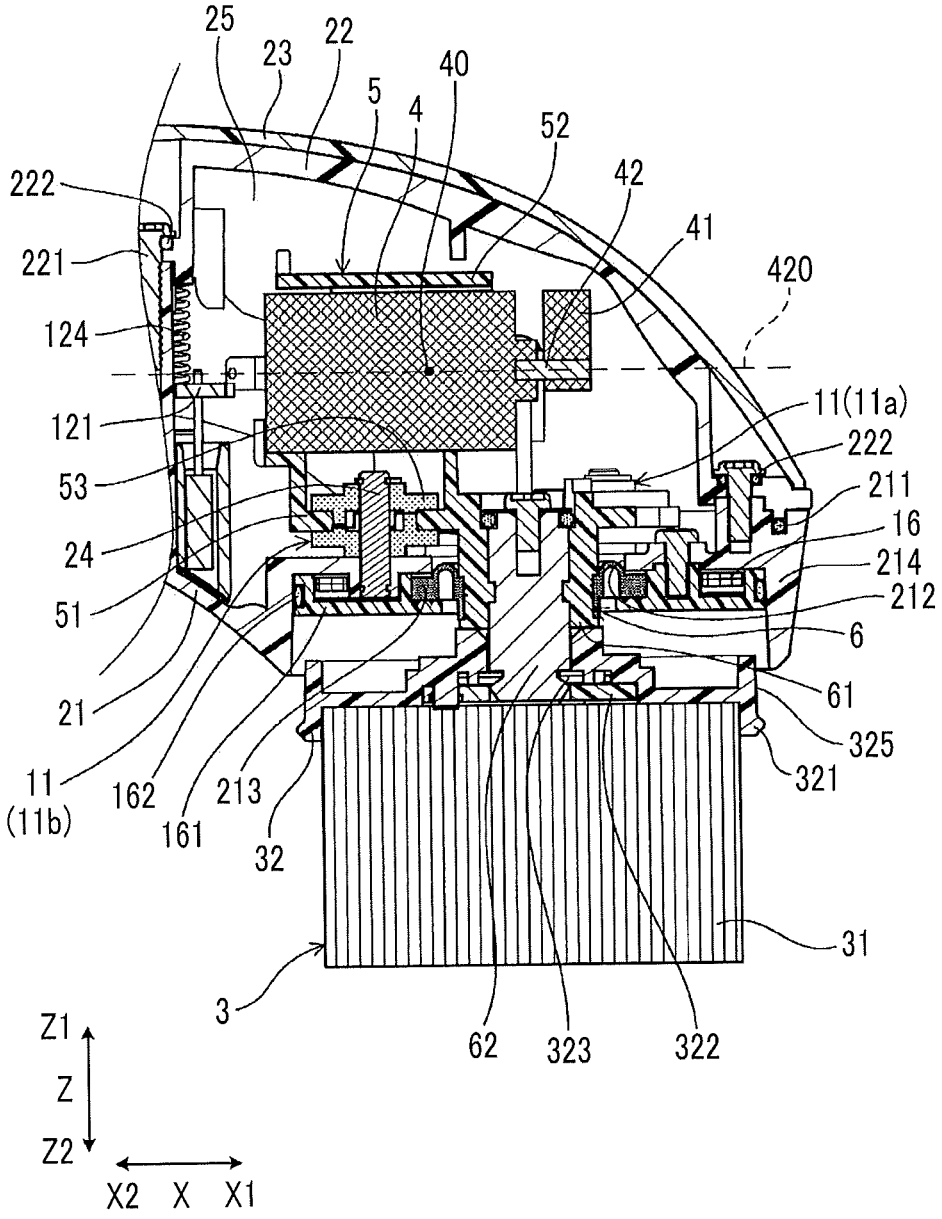
FIG. 6 is a cross-sectional view taken along a line VI-VI of FIG. 5.

An example of the cosmetic device will be described with reference to the drawings. As illustrated in FIGS. 1 to 3, a cosmetic device 1 has a main body portion 2, and a brush portion 3 disposed outside the main body portion 2. Further, as illustrated in FIG. 6, the cosmetic device 1 has a vibration motor 4 having a rotary shaft 42 equipped with an eccentric weight 41, a motor holding portion 5 which holds the vibration motor 4, a coupling portion 11 (11*a*, 11*b*) that couples the motor holding portion 5 with respect to the main body portion 2 in a relatively displaceable state, and a brush attachment portion 6 extending from the motor holding portion 5 and connected to the brush portion 3. As illustrated in FIG. 6, the brush attachment portion 6 extends in a direction different from the axial direction 420 of the rotary shaft 42 in the vibration motor 4.

Figure 4:
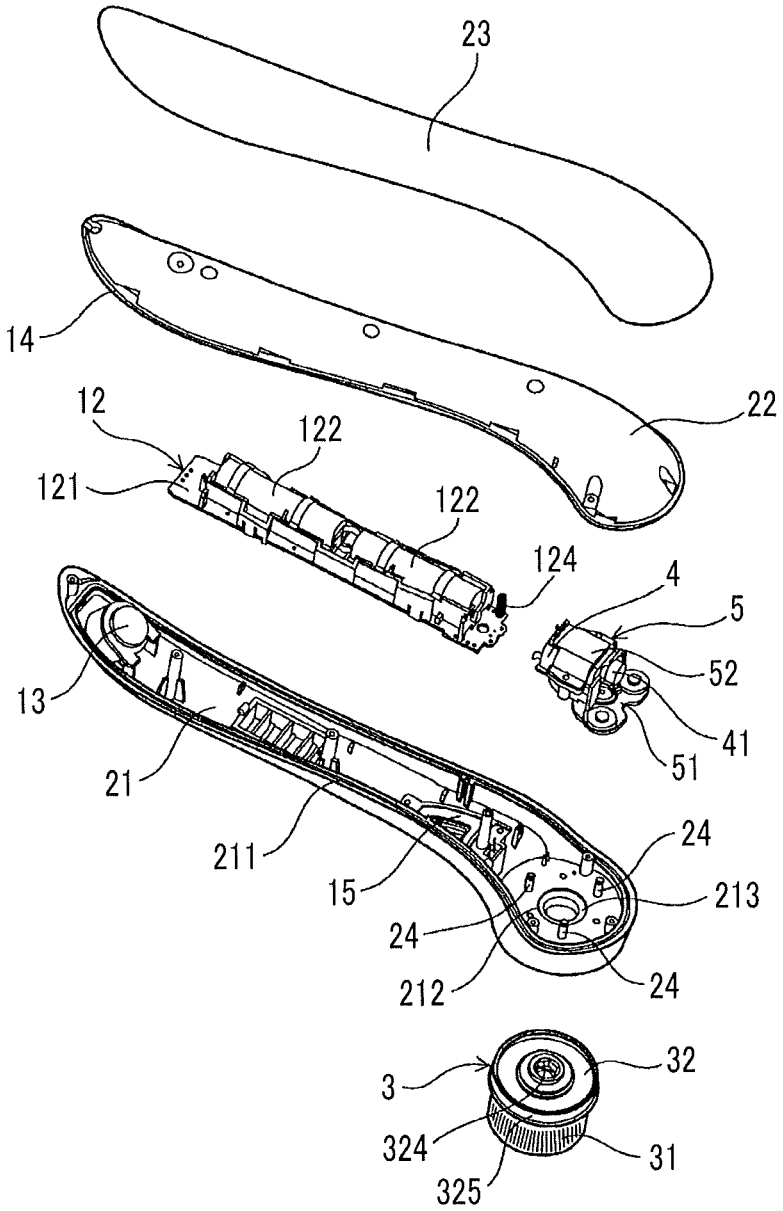
FIG. 4 is a developed view of components of the cosmetic device in the first example.
Figure 5:
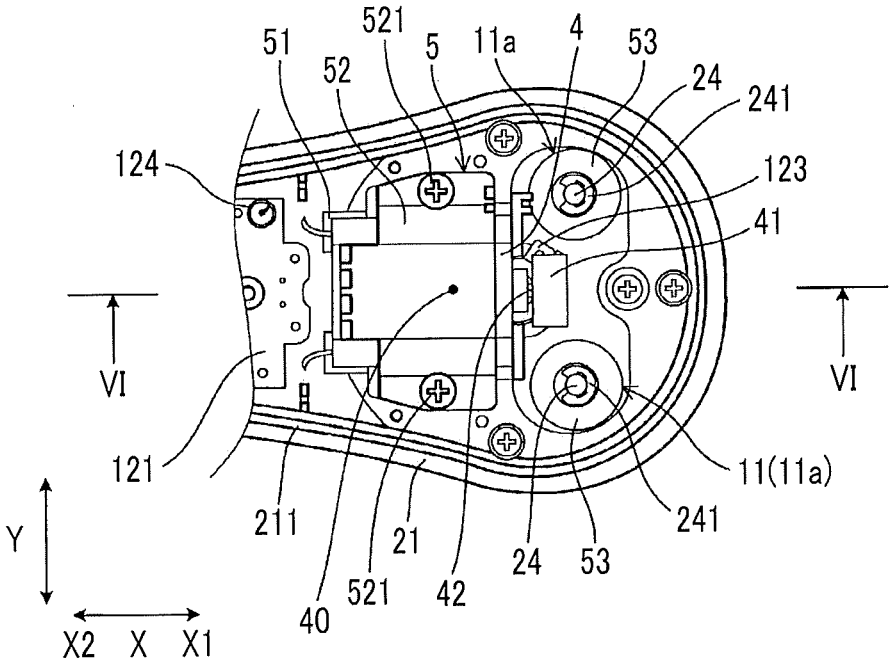
FIG. 5 is a top view of a state in which a motor holding portion is attached to a head portion of the cosmetic device in the first example.

As illustrated in FIGS. 1 to 3, the main body portion 2 of the cosmetic device 1 has a rod-like shape. As illustrated in FIGS. 4 to 6, the vibration motor 4 and the motor holding portion 5 are stored at the end portion of the main body portion 2 in the longitudinal direction. In FIGS. 4 to 6, for the sake of simplicity, the description of connecting components such as screws and electric wires will be partially omitted.

As illustrated in FIGS. 5 and 6, the rotary shaft 42 of the vibration motor 4 extends along the longitudinal direction of the main body portion 2. Further, as illustrated in FIG. 6, the brush attachment portion 6 extends in a direction perpendicular to the axial direction 420 of the rotary shaft 42 in the vibration motor 4. The brush attachment portion 6 extends to the outside of the main body portion 2. A brush portion 3 is detachably attached to a tip of the brush attachment portion 6.

As illustrated in FIGS. 1 to 3, the brush portion 3 of this example is disposed on the side peripheral surface of the main body portion 2. Further, the brush portion 3 of this example has a large number of fibers extending along the extension direction of the brush attachment portion 6.

Hereinafter, in some cases, the axial direction 420 of the rotary shaft 42 in the vibration motor 4 is referred to as a "front-rear direction X," a side on which the vibration motor 4 is stored in the front-rear direction X is referred to as a "front side X1," and the opposite side thereof is referred to as "X2." Further, the extension direction of the brush attachment portion 6 may be referred to as a "vertical direction Z," the brush portion 3 side in the vertical direction Z may be referred to as a "lower side Z2," and the opposite side thereof may be referred to as an "upper side Z1." Further, a direction orthogonal to both the front-rear direction X and the vertical direction Z may be referred to as a "width direction Y." All the descriptions regarding the directions of the cosmetic device 1 are for convenience and are not related to the orientation when the cosmetic device 1 is actually used.

In the cosmetic device 1 of this example, the cross-sectional shape of the main body portion 2 in the front-rear direction X is a substantially elliptical shape. Further, as illustrated in FIGS. 2 and 3, the central portion 20 of the main body portion 2 in the front-rear direction X is slightly thinner than both end portions.

As illustrated in FIG. 4, the main body portion 2 includes a lower housing 21 from which the brush attachment portion 6 protrudes, an intermediate housing 22 fastened to the lower housing 21 via screws 221 (see FIG. 6), and an upper housing 23 engaged with the intermediate housing 22. As illustrated in FIGS. 1 to 3, the lower housing 21 constitutes an outer wall of a lower half of the main body portion 2. Further, the upper housing 23 constitutes an outer wall of an upper half of the main body portion 2.

The outer peripheral end edge of the intermediate housing 22 is exposed between the lower housing 21 and the upper housing 23 on the outer surface of the main body portion 2. The lower housing 21, the intermediate housing 22, and the upper housing 23 are made of ABS resin. Further, a plating film having conductivity is formed on the surface of the intermediate housing 22.

As illustrated in FIG. 6, a hollow portion 25 that stores components for operating the cosmetic device 1 is formed between the lower housing 21 and the intermediate housing 22. As illustrated in FIGS. 4 to 6, an O-ring 211 is sandwiched between the outer peripheral end edge of the lower housing 21 and the outer peripheral end edge of the intermediate housing 22. As illustrated in FIG. 6, an O-ring 222 is also sandwiched between the intermediate housing 22 and a screw 221 for fastening the intermediate housing 22 to the lower housing 21. The cosmetic device 1 is configured so that moisture and the like can be prevented from entering the hollow portion 25 from the space between the lower housing 21 and the intermediate housing 22 by these O rings 211 and 222.

As illustrated in FIG. 6, the lower housing 21 has a brush storage wall portion 214 around an opening portion 212 from which the brush attachment portion 6 protrudes. The brush storage wall portion 214 is erected from the lower housing 21 toward the lower side Z2. Further, the brush portion 3 is detachably attached to the interior of the brush storage wall portion 214.

Further, as illustrated in FIG. 4, the lower housing 21 has three guide rods 24 at the end portion of the front side X1. The guide rods 24 are erected toward the upper side Z1. A locking groove 242 (see FIG. 7) for attaching an E-ring 241 (see FIGS. 5 and 7) is formed at the upper end portion of the guide rods 24.

Figure 8:
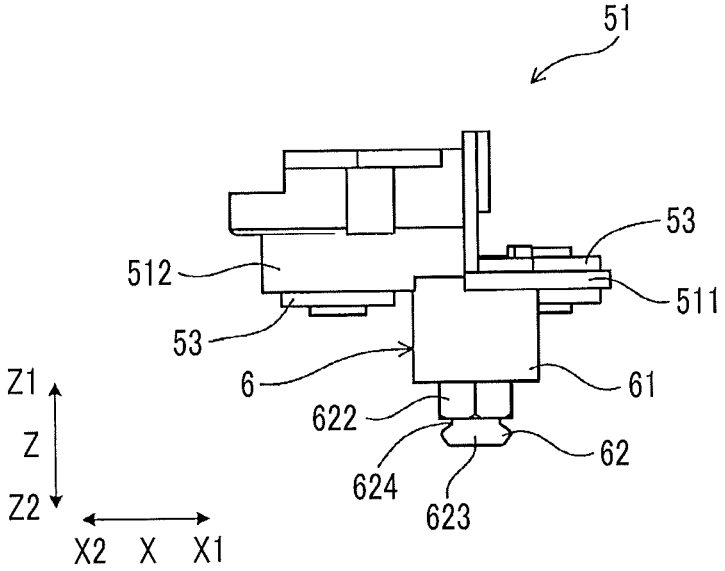
FIG. 8 is a side view of the motor base in the first example.
Figure 9:
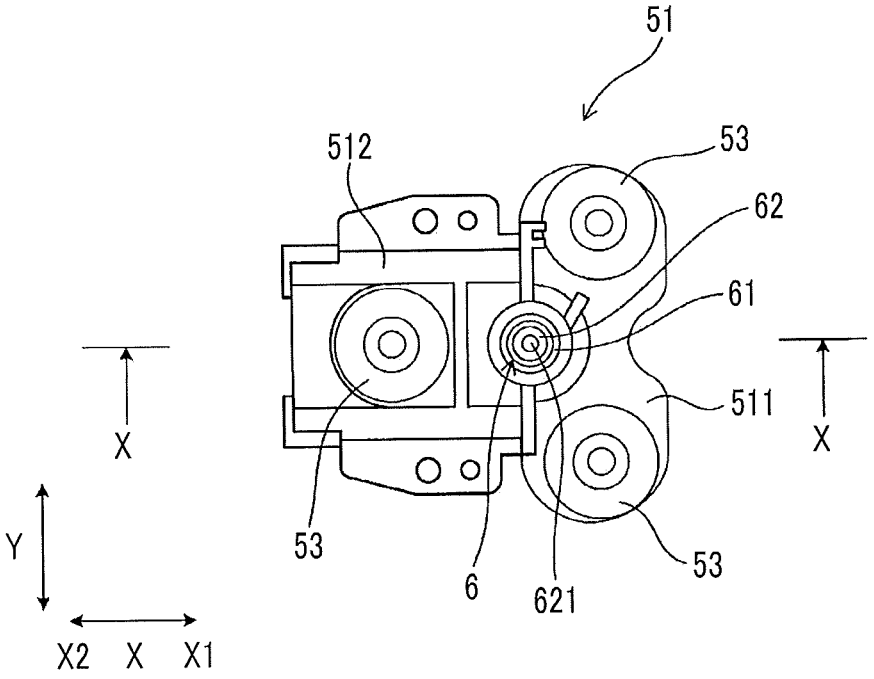
FIG. 9 is a top view of the motor base in the first example.
Figure 10:
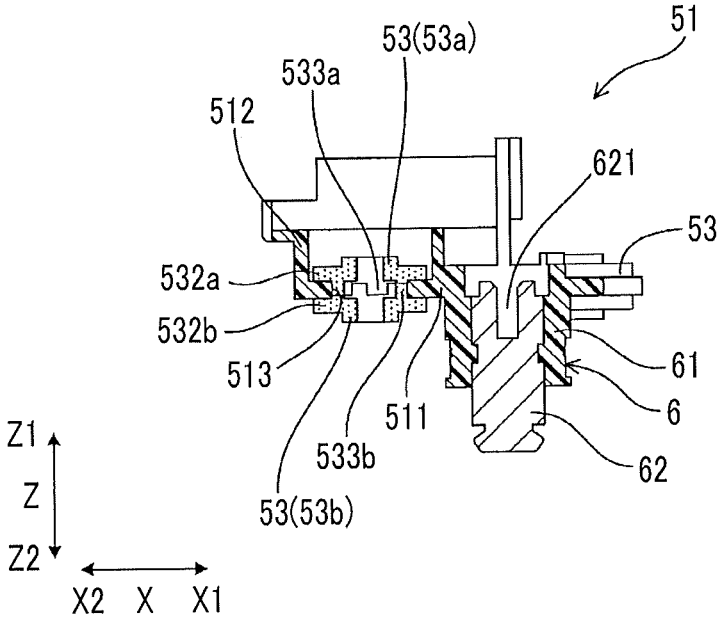
FIG. 10 is a cross-sectional view taken along a line X-X of FIG. 9.

As illustrated in FIG. 6, the motor holding portion 5 has a motor base 51 attached to the guide rods 24, and a motor cover 52 that holds the vibration motor 4 between the motor base 51 and the motor cover 52. As illustrated in FIGS. 8 to 10, the motor base 51 has a plate-like portion 511, and a motor receiving portion 512 protruding from the plate-like portion 511 toward the upper side Z1. The plate-like portion 511 and the motor receiving portion 512 of this example are made of ABS resin.

Figure 7:
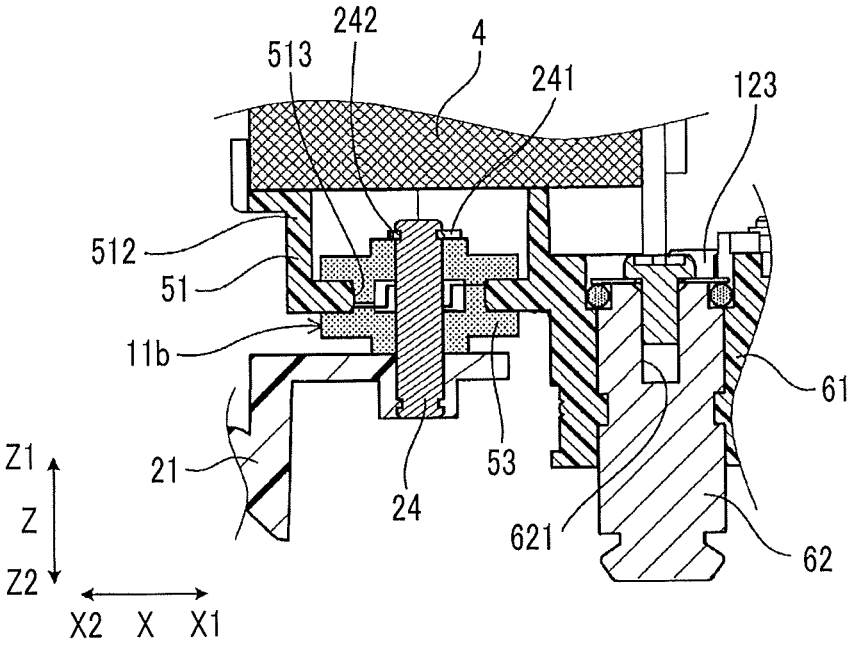
FIG. 7 is an enlarged view of a main part of FIG. 6.

The plate-like portion 511 has three insertion holes 513 (see FIG. 10). As illustrated in FIGS. 7, 9, and 10, the elastic member 53 is attached to the insertion holes 513 from both sides in the vertical direction Z.

Figure 11:
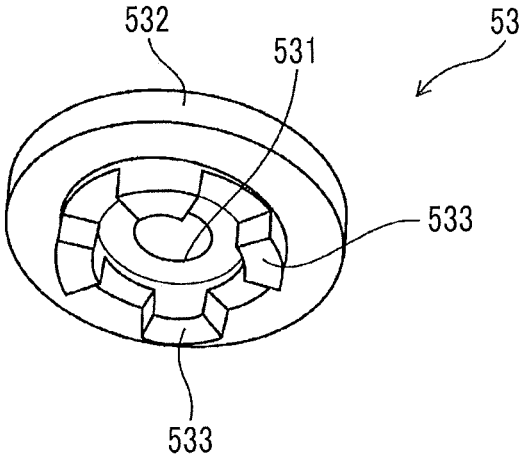
FIG. 11 is a perspective view of an elastic member in the first example.

The elastic member 53 of this example is made of styrene rubber. As illustrated in FIG. 11, the elastic member 53 includes a rubber base portion 532 having a disk shape and including insertion holes 531 through which the guide rods 24 are inserted, and four protrusions 533 erected around the insertion hole 531. The width of each protrusion 533 is substantially the same as the interval between the adjacent protrusions 533.

As illustrated in FIG. 10, in the insertion hole 513, a protrusion 533*b* of the other elastic member 53*b* is inserted between the adjacent protrusions 533*a* of one of the pair of elastic members 53 (53*a*, 53*b*). Further, the plate-like portion 511 is sandwiched between a pair of rubber base portions 532 (532*a*, 532*b*).

As illustrated in FIGS. 5 to 7, the guide rods 24 of the lower housing 21 are inserted through the elastic member 53. Further, as illustrated in FIGS. 6 and 7, the guide rods 24 protrude upward Z1 from the upper end surface of the elastic member 53. As illustrated in FIG. 7, the locking groove 242 for attaching the E-ring 241 is formed on the protruding portion.

As illustrated in FIGS. 5 and 7, by attaching the E-ring 241 to the locking groove 242, the motor base 51 can be coupled to the lower housing 21 in a relatively displaceable state. In this way, the coupling portion 11 of this example is configured to include the elastic member 53 held by the plate-like portion 511 of the motor base 51, the guide rod 24 provided in the lower housing 21, and the E-ring 241 attached to the locking groove 242. Further, the cosmetic device 1 of this example has three coupling portions 11. Each coupling portion 11 has one of the guide rods 24 provided in the main body portion 2, and the elastic member 53 held by the motor base 51, and the guide rod 24 penetrates the elastic member 53.

The motor cover 52 is fastened to the motor receiving portion 512 by screws 521 illustrated in FIG. 5. The vibration motor 4 is sandwiched between the motor cover 52 and the motor receiving portion 512. The motor cover 52 of this example is made of ABS resin.

The vibration motor 4 of this example is a cylinder type vibration motor 4. The vibration motor 4 is disposed so that the axial direction 420 of the rotary shaft 42 extends in the longitudinal direction of the main body portion 2. In addition, the eccentric weight 41 of the vibration motor 4 is disposed on the front side X1 in the front-rear direction X.

As illustrated in FIGS. 5 and 6, two coupling portions 11*a* among the three coupling portions 11 (11*a*, 11*b*) are disposed on the front side X1 of the rotary shaft 42 in the axial direction with respect to the center of gravity 40 of the vibration motor 4 420, and the remaining one coupling portion 11*b* is disposed on the rear side X2.

As illustrated in FIG. 9, the brush attachment portion 6 is provided at the center of three insertion holes 513 in the top view. As illustrated in FIG. 10, the brush attachment portion 6 has a tubular portion 61 integrally formed with the plate-like portion 511, and a shaft 62 penetrating the tubular portion 61 in the vertical direction Z. As illustrated in FIG. 6, an end portion of the lower side Z2 of the tubular portion 61 extends to the outside of the main body portion 2 via the opening portion 212 of the lower housing 21.

Further, the space between the lower housing 21 and the tubular portion 61 in the opening portion 212 is closed by a seal member 213. It is possible to prevent moisture or the like from entering the hollow portion 25 from the opening portion 212, by the seal member 213. The seal member 213 of this example is made of nitrile rubber.

The shaft 62 of this example is made of a metal. As illustrated in FIG. 6, an end portion of the upper side Z1 of the shaft 62 extends to the interior of the hollow portion 25. Further, a screw hole 621 (see FIGS. 7 and 10) which electrically connects the shaft 62 and the current generating portion 12 (to be described later) is provided on the upper end surface of the shaft 62. As illustrated in FIG. 8 and FIG. 10, the end portion of the lower side Z2 of the shaft 62 protrudes to the lower side Z2 from the tubular portion 61. As illustrated in FIG. 8, the protruding portion has a rotation restricting portion 622 having a hexagonal prism shape, and a brush engaging portion 623 protruding to the lower side Z2 from the rotation restricting portion 622. A groove portion 624 for engaging the brush portion 3 is provided at the brush engaging portion 623.

As illustrated in FIG. 6, the brush portion 3 has the brush main body 31 made of a large number of fibers, and the brush holder 32 which holds the brush main body 31. The fibers of the brush main body 31 extend in the vertical direction Z, that is, in the extension direction of the brush attachment portion 6.

Figure 12:
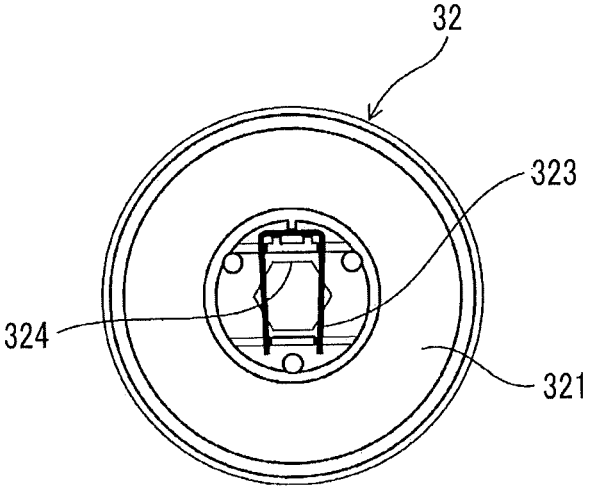
FIG. 12 is a bottom view of the brush holder in the first example.

As illustrated in FIG. 12, the brush holder 32 includes a holder main body portion 321 having a cup shape, a spring cover 322 (see FIG. 6) disposed at the center of the holder main body portion 321 in a bottom view, and a brush mounting spring 323 held between the holder main body portion 321 and the spring cover 322. As illustrated in FIGS. 4 and 12, a hexagonal insertion hole 324 corresponding to the shape of the rotation restricting portion 622 (see FIG. 8) of the shaft 62 is formed at the center of the holder main body portion 321. By inserting the rotation restricting portion 622 into the insertion hole 324 and by engaging the brush mounting spring 323 inside the groove portion 624, the brush portion 3 can be detachably mounted. Further, by inserting the rotation restricting portion 622 into the insertion hole 324, it is possible to restrict the rotational motion of the brush portion 3 around the brush attachment portion 6 in a state in which the brush portion 3 is mounted.

When the eccentric weight 41 of the vibration motor 4 is rotated in the cosmetic device 1 of this example, the vibration motor 4 vibrates due to its inertia. With the vibration of the vibration motor 4, minute displacement or inclination occurs in the motor holding portion 5. The direction of displacement or inclination of the motor holding portion 5 changes in various directions, depending on the rotational speed of the vibration motor 4, the specific shape of the motor holding portion 5, and the like.

Figure 13A:
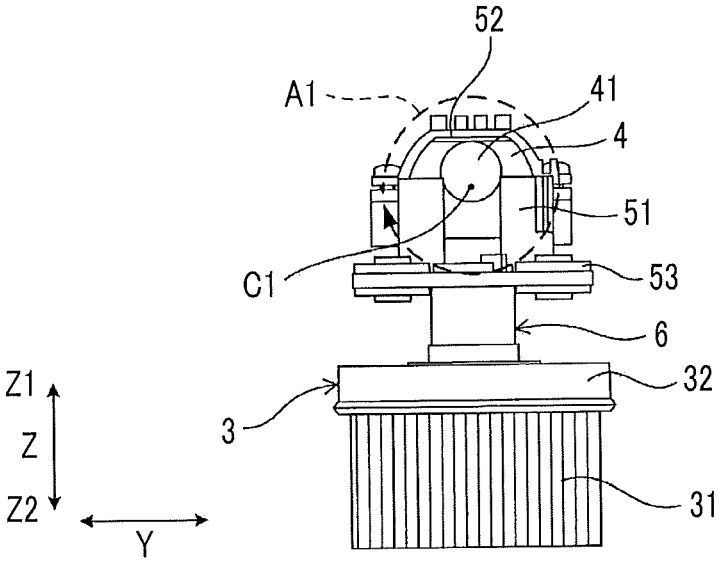
FIG. 13A is a front view illustrating an example of a rotational motion of the motor holding portion.
Figure 13B:
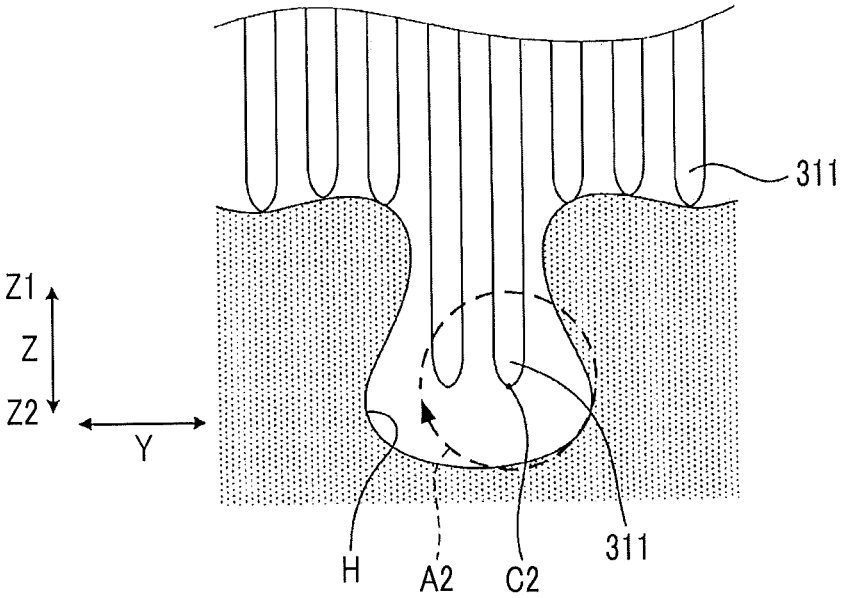
FIG. 13B is a front view illustrating an example of a motion of a brush tip of the brush portion according to the rotational motion in the first example.

For example, as illustrated in FIG. 13A, the motor holding portion 5 may rotate about the central axis C1 extending in the front-rear direction X (arrow A1) due to the inertia of the eccentric weight 41. When the rotational motion is transmitted to the brush portion 3 via the brush attachment portion 6, the brush tips 311 of the brush main body 31 rotate about the central axis C2 extending in the front-rear direction X as illustrated in FIG. 13B (arrow A2). As a result, vibration accompanied by displacement in the width direction Y and displacement in the vertical direction Z is applied to the brush tips 311 of the brush main body 31.

Figure 14A:
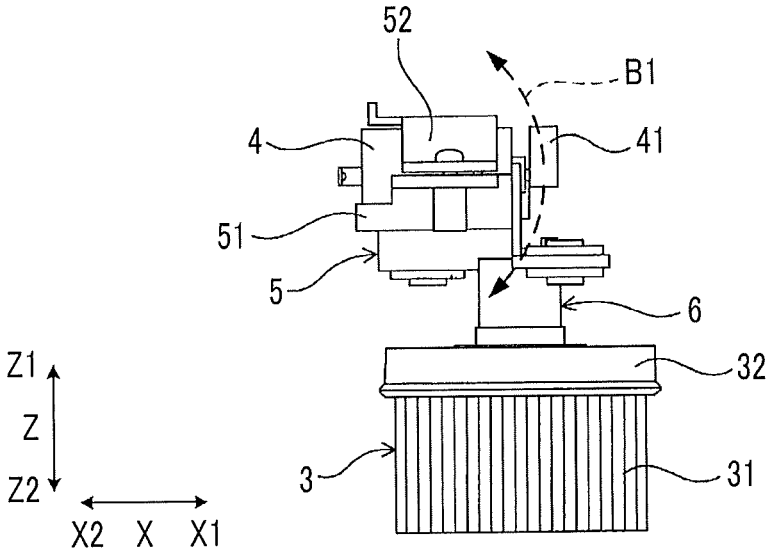
FIG. 14A is a side view illustrating an example of inclination of the motor holding portion.
Figure 14B:
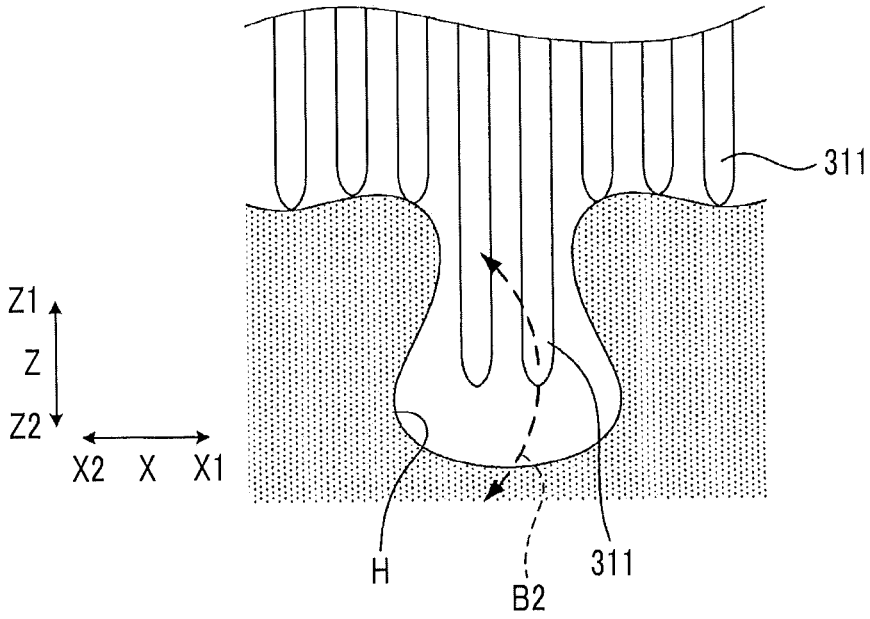
FIG. 14B is a side view illustrating an example of a motion of a brush tip of the brush portion according to the inclination in the first example.

Further, in this example, the position of the rotation center of the eccentric weight 41 and the center of gravity of the vibration motor 4 are different from each other in the front-rear direction X. Therefore, a rotational moment about the central axis extending in the width direction Y is generated with the rotation of the eccentric weight 41, and as illustrated in FIG. 14A, the motor holding portion 5 may be inclined in the front-rear direction X (arrow B1). When the inclination is transmitted to the brush portion 3 via the brush attachment portion 6, as illustrated in FIG. 14B, vibration accompanied by displacement in the front-rear direction X and displacement in the vertical direction Z is imparted to the brush tips 311 of the brush main body 31 (arrow B2).

The motion of the brush tips 311 of the brush main body 31 illustrated in FIGS. 13A to 14B is an example, and when the motor holding portion 5 vibrates or tilts in various directions, the vibration accompanied by complex displacement obtained by combining the displacement in the front-rear direction X, the width direction Y and the vertical direction Z can be imparted to the brush tips 311 of the brush main body 31.

Next, other parts of the cosmetic device 1 of this example will be described in more detail. As illustrated in FIGS. 4 and 6, the current generating portion 12 and the power receiving coil portion 13 are stored in the hollow portion 25 between the lower housing 21 and the intermediate housing 22. The current generating unit 12 has a control board 121 which controls the driving of the vibration motor 4, and a power supply portion 122 which supplies electric power to the control board 121 and the vibration motor 4. The control board 121 and the power supply portion 122 are engaged with each other, and are disposed in the central portion of the cosmetic device 1 in the front-rear direction X. The control board 121 is electrically connected to the vibration motor 4, the power supply portion 122, and the power receiving coil portion 13 via wires (not illustrated).

The power supply portion 122 of this example is a secondary battery. The power receiving coil portion 13 is disposed at the end portion of the rear side X2 in the front-rear direction X. The power receiving coil portion 13 is configured to be able to receive the power transmitted from the power transmission coil disposed outside the cosmetic device 1. The power received by the power receiving coil portion 13 is charged to the power supply portion 122 via the control board 121.

Figure 15:
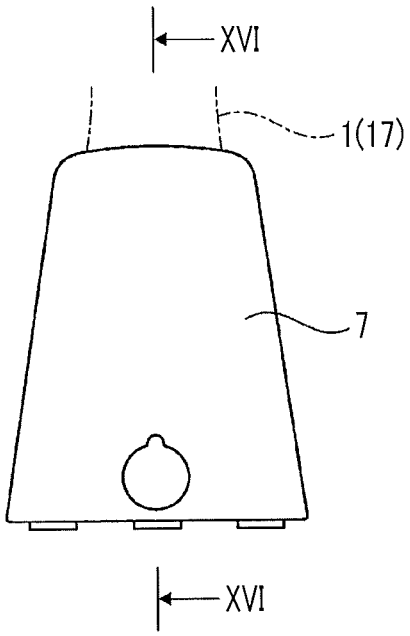
FIG. 15 is a front view of a charging stand for charging the cosmetic device of the first example.
Figure 16:
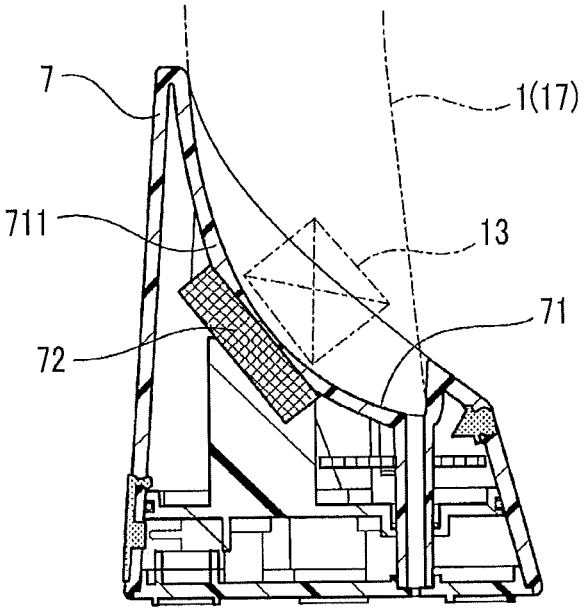
FIG. 16 is a cross-sectional view taken along a line XVI-XVI of FIG. 15.

More specifically, the cosmetic device 1 of this example can be charged using the charging stand 7 illustrated in FIGS. 15 and 16. As illustrated in FIG. 16, the charging stand 7 is configured to have a recessed portion 71 corresponding to the shape of the rear end portion 17 of the cosmetic device 1, that is, the end portion on the side in which the power receiving coil portion 13 is built, such that the rear end 17 of the cosmetic device 1 can be inserted into the recessed portion 71. A power transmission coil 72 is stored inside the charging stand 7. The power transmission coil 72 is disposed at a position at which it faces the power receiving coil portion 13 via a wall portion 711 of the charging stand 7 and the lower housing 21 (not illustrated), in a state in which the rear end portion 17 of the cosmetic device 1 is inserted in the recessed portion 71.

Further, the cosmetic device 1 of this example is configured to be able to more efficiently remove impurities and the like having electric charges, by allowing a weak current to flow through the skin at the time of use. That is, as illustrated in FIGS. 3, 4 and 6, the brush portion 3 of this example has a brush main body 31 made of a large number of fibers, a brush holder 32 that holds the brush main body 31, and a brush electrode 325 disposed on the outer surface of the brush holder 32. As illustrated in FIG. 4, the main body portion 2 has the current generating portion 12 stored inside, and the main body electrode 14 disposed on the outer surface. The brush electrode 325 and the main body electrode 14 are electrically connected to each other via the current generating portion 12.

The brush electrode 325 of this example is made of a plating film having conductivity. The brush electrode 325 is provided on the surface of the holder body portion 321, and is electrically connected to the shaft 62 of the brush attachment portion 6 via the brush mounting spring 323. Further, a terminal 123 (see FIGS. 5 and 7) of the electric wire extending from the control board 121 is fastened to the screw hole 621 provided at the end portion of the upper side Z1 of the shaft 62 by screws. Thus, the brush electrode 325 and the current generating portion 12 are electrically connected to each other.

Further, the main body electrode 14 of this example is made of a plating film having conductivity. The main body electrode 14 is provided on the surface of the intermediate housing 22, and is exposed between the lower housing 21 and the upper housing 23 on the outer surface of the main body portion 2, as illustrated in FIGS. 1 and 3. Further, the main body electrode 14 abuts an energizing spring 124 (see FIGS. 4 to 6) erected from the control board 121 toward the upper side Z1 inside the hollow portion 25. As a result, the main body electrode 14 and the current generating portion 12 are electrically connected to each other.

In the cosmetic device 1 of the present example, by pushing a changeover switch (not illustrated) of the control board 121 via a switch plate 15 (see FIGS. 2 and 3) disposed at the central portion of the lower housing 21 in a bottom view, it is possible to perform the changeover between the ON state and the OFF state of the vibration motor 4, and the changeover between the generation and stop of a weak current flowing to the skin via the brush electrode 325 and the main body electrode 14.

As illustrated in FIG. 6, a light-emitting module 16 is disposed inside the brush storage wall portion 214 of the lower housing 21. The light-emitting module 16 is electrically connected to the control board 121 via an electric wire (not illustrated). Further, the light-emitting module 16 is configured to emit light when the vibration motor 4 is on.

The lower side Z2 of the light-emitting module 16 is covered with a lid portion 161. An O-ring 162 is sandwiched between the lid portion 161 and the brush storage wall portion 214. Therefore, it is possible to prevent moisture or the like from entering the light-emitting module 16 side from the space between the lid portion 161 and the brush storage wall portion 214.

Next, the operational effects of this example will be described. As illustrated in FIG. 6, in the cosmetic device 1, the motor holding portion 5 which holds the vibration motor 4 is coupled to the main body portion 2 via a coupling portion 11 in a relatively displaceable state. Therefore, the relative position of the motor holding portion 5 with respect to the main body portion 2 can be changed relatively freely, without being strongly restrained by the main body portion 2. Therefore, the cosmetic device 1 can efficiently transmit the vibration of the vibration motor 4 to the motor holding portion 5 and the brush attachment portion 6 extending from the motor holding portion 5 even in a state in which the main body portion 2 is fixed.

Further, the brush attachment portion 6 extends in a direction different from the axial direction 420 of the rotary shaft 42 of the vibration motor 4. Therefore, the vibration of the brush attachment portion 6 imparted by the vibration motor 4 is accompanied by complex displacement caused by combining the displacement in the axial direction 420 (the front-rear direction X) of the rotary shaft 42, and the displacement in the arbitrary direction (the width direction Y, and the vertical direction Z) orthogonal to the axial direction 420. Further, since the vibration is efficiently transmitted to the brush portion 3 via the brush attachment portion 6, for example, as illustrated in FIGS. 13A to 14B, the complex displacement caused by combining the displacement in the depth direction of the pores H (the vertical direction Z) and the displacement in an arbitrary direction (the front-rear direction X, and the width direction Y) orthogonal to the direction can be imparted to the brush tip 311 of the brush portion 3. As a result, it is possible to efficiently remove dirt or the like adhering to the surface of the skin or the interior of the pores by the brush portion 3.

Furthermore, in this example, the brush attachment portion 6 extends in a direction (the vertical direction Z) perpendicular to the axial direction 420. Therefore, in the vibration of the brush attachment portion 6 described above, it is possible to further increase the amplitude in an arbitrary direction (the width direction Y, and the vertical direction Z) orthogonal to the axial direction 420, and it is possible to suppress the amplitude in the axial direction 420 (the front-rear direction X) from excessively increasing. Therefore, the brush tips 311 of the brush portion 3 can be greatly vibrated in the depth direction of the pores. Therefore, it is possible to more efficiently remove dirt or the like adhering to the insides of the pores, while further reducing the friction between the brush tips 311 of the brush portion 3 and the surface of the skin.

As illustrated in FIGS. 5 to 7, the coupling portion 11 has the elastic member 53 interposed between the main body portion 2 and the motor holding portion 5. Therefore, when the vibration motor 4 is vibrated, the motor holding portion 5 receives a repulsive force from the elastic member 53, and the vibration can be efficiently transmitted by the brush attachment portion 6. As a result, the amplitude of the brush attachment portion 6 can be further increased, and it is possible to more efficiently remove dirt adhering to the surface of the skin or in the pores.

Further, the coupling portion 11 has the guide rod 24 provided on the main body portion 2 and the elastic member 53 held by the motor holding portion 5, and the guide rod 24 penetrates the elastic member 53. Therefore, the motor holding portion 5 and the brush attachment portion 6 continuous therewith can move relatively freely along the guide rod 24. As a result, it is possible to further increase the amplitude of the brush attachment portion 6 in the direction along the guide rod 24, and it is possible to more efficiently remove dirt adhering to the surface of the skin or in the pores. Further, it is also possible to obtain the effect of more easily assembling the cosmetic device 1.

As illustrated in FIGS. 4 to 6, the cosmetic device 1 has three coupling portions 11. Therefore, it is possible to reduce the load applied to each coupling portion 11 by the weight of the vibration motor 4 and the motor holding portion 5. As a result, the structure of the coupling portion 11 can be made simpler, which makes it easier to reduce the weight of the cosmetic device 1.

The two coupling portions 11 among the three coupling portions 11 are disposed on the front side X1 in the axial direction 420 of the rotary shaft 42 with respect to the center of gravity of the vibration motor 4, and the remaining one coupling portion 11 is disposed on the rear side X2. Further, the brush attachment portion 6 extends in a direction (vertical direction Z) perpendicular to the axial direction 420 (front-rear direction X) of the rotary shaft 42 in the vibration motor 4. Further, as the vibration motor 4, a cylinder type vibration motor 4 is adopted. As a result, in the vibration of the brush attachment portion 6, the displacement (the front-rear direction X) in the axial direction 420, and the displacement in an arbitrary direction (the width direction Y, and the vertical direction Z) orthogonal to the axial direction 420 can be increased in a well-balanced manner. This makes it possible to impart more complex vibration to the brush tips of the brush portion 3. As a result, it is possible to more efficiently remove dirt or the like adhering to the surface of the skin or in the pores.

The brush attachment portion 6 has a rotation restricting portion 622 which restricts the rotational motion of the brush portion 3 centered on the brush attachment portion 6. Therefore, it is possible to prevent the skin from being scratched with the rotational motion of the brush portion 3. As a result, irritation to the skin during use of the cosmetic device 1 can be further reduced.

The brush portion 3 has a large number of fibers extending in the extension direction of the brush attachment portion 6. Therefore, it is possible to efficiently transmit the vibration of the brush attachment portion 6 to the brush tips of the brush portion 3. As a result, it is possible to more efficiently remove dirt or the like adhering to the surface of the skin or in the pores.

Further, the brush portion 3 has a brush main body 31 made of a large number of fibers, a brush holder 32 which holds the brush main body 31, and a brush electrode 325 disposed on the outer surface of the brush holder 32. The main body portion 2 has the current generating portion 12 stored inside, and the main body electrode 14 disposed on the outer surface. Further, the brush electrode 325 and the main body electrode 14 are electrically connected to each other via the current generating portion 12.

Therefore, when the user grasps the main body electrode 14 and a liquid or foam-like cleaning agent having conductivity is interposed between the brush electrode 325 and the skin, it is possible to form a closed circuit which includes the user, the brush electrode 325, the current generating unit 12, and the main body electrode 14. By allowing a weak current to flow through the closed circuit, it is possible to more easily remove impurities having electric charge from the skin. As a result, it is possible to more efficiently remove impurities and the like having electric charges.

Further, the main body portion 2 has a rod shape, and the vibration motor 4 and the motor holding portion 5 are stored at the end portion of the main body portion 2 in the longitudinal direction. Therefore, the user can easily grasp the main body portion 2. Therefore, usability of the cosmetic device 1 can be further improved.

Further, the brush portion 3 is disposed on the side peripheral surface of the main body portion 2. Therefore, the user can easily bring the brush tips of the brush portion 3 into contact with the skin. Thus, usability of the cosmetic device 1 can be further improved.

Second Example

Figure 17:
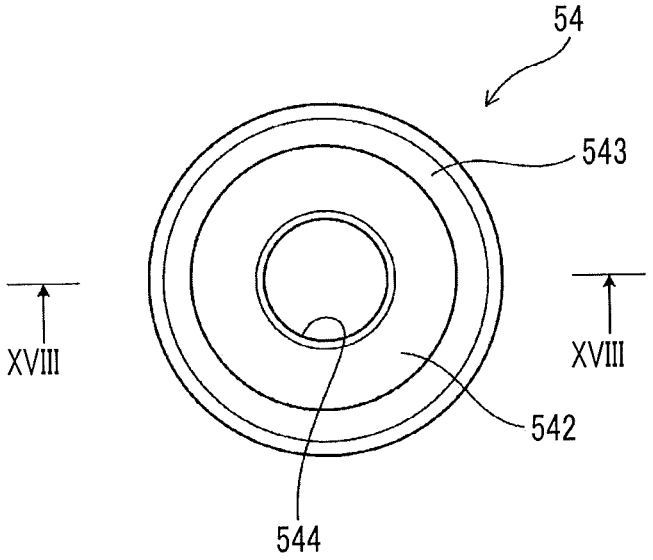
FIG. 17 is a top view of an elastic member in a second example.
Figure 18:
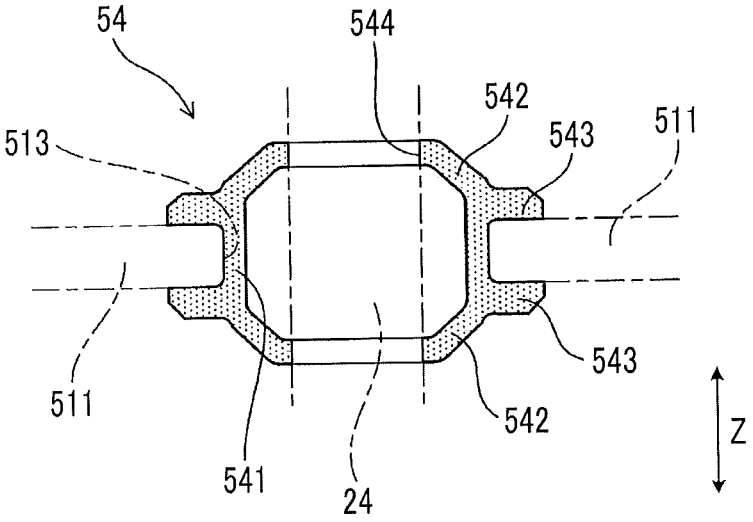
FIG. 18 is a cross-sectional view taken along a line XVIII-XVIII of FIG. 17.

This is an example in which the shape of the elastic member is changed. Further, among the reference numerals used in the example, the same reference numerals as those used in the previous example represent the same constituent elements and the like, unless otherwise specified. As illustrated in FIGS. 17 and 18, an elastic member 54 of this example has a rubber proximal portion 541 having a tubular shape, a pair of tapered portions 542 extending in the central axis direction (vertical direction Z) from the opening end of the rubber proximal portion 541A, and a pair of flange portions 543 protruding outward from the boundary between the rubber proximal portion 541 and the tapered portions 542.

As illustrated in FIG. 18, the tapered portions 542 extend toward the central axis as they move farther from the rubber proximal portion 541 with the opening end of the rubber proximal portion 541 as a proximal end. Further, an opening portion 544 through which the guide rod 24 is inserted is provided at the leading end of the tapered portion 542.

As illustrated in FIG. 17, the flange portions 543 are provided over the entire circumference of the boundary between the rubber proximal portion 541 and the tapered portion 542.

As illustrated in FIG. 18, in a state in which the elastic member 54 is attached to the motor base 51, the rubber proximal portion 541 is stored in the insertion hole 513 of the plate-like portion 511. Further, the plate-like portion 511 is sandwiched between the pair of flanges 543. The guide rod 24 is inserted into the elastic member 54 via the opening portion 544 of the tapered portion 542 and penetrates the elastic member 54. The inner surface of the rubber proximal portion 541 is separated from the outer surface of the guide rod 24.

As in this example, by separating the inner surface of the rubber proximal portion 541 from the outer surface of the guide rod 24, it is possible to further reduce the friction with the guide rod 24 that occurs when the elastic member 54 moves. Therefore, the elastic member 54 of this example can be more freely moved in the direction along the guide rod 24. Further, as the elastic member 54 freely moves in this direction, it is possible to further increase the amplitude of the brush attachment portion 6 in the direction, and it is possible to further increase the amplitude of the brush tip 311 of the brush portion 3 in that direction.

Further, since the tapered portion 542 has relatively low rigidity, the tapered portion 542 is easily deformed upon contact with the E-ring 241 or the lower housing 21. Further, when the tapered portion 542 is deformed, the rubber proximal portion 541 can be brought closer to the E-ring 241 or the lower housing 21. By providing the tapered portions 542 at both ends of the rubber proximal portion 541 in this way, it is possible to further increase the amplitude of the elastic member 54 in the direction along the guide rod 24. As a result, it is possible to further increase the amplitude of the brush attachment portion 6 in the direction along the guide rod 24, and it is possible to further increase the amplitude of the brush tip 311 of the brush portion 3 in that direction.

Third Example

Figure 19:
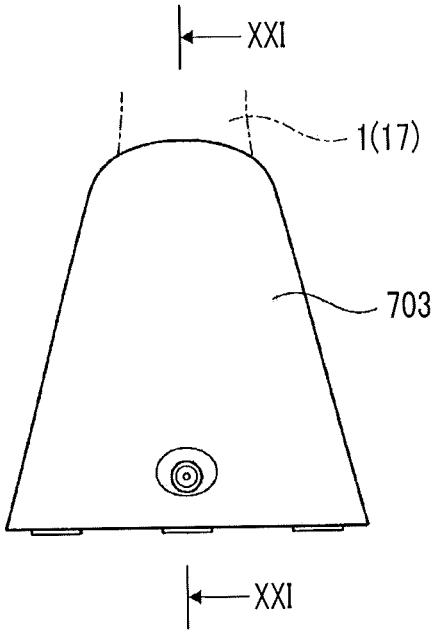
FIG. 19 is a front view of a charging stand in a third example.
Figure 20:
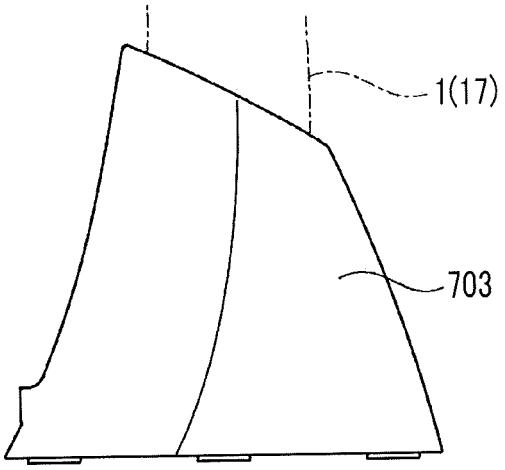
FIG. 20 is a side view of the charging stand in the third example.
Figure 21:
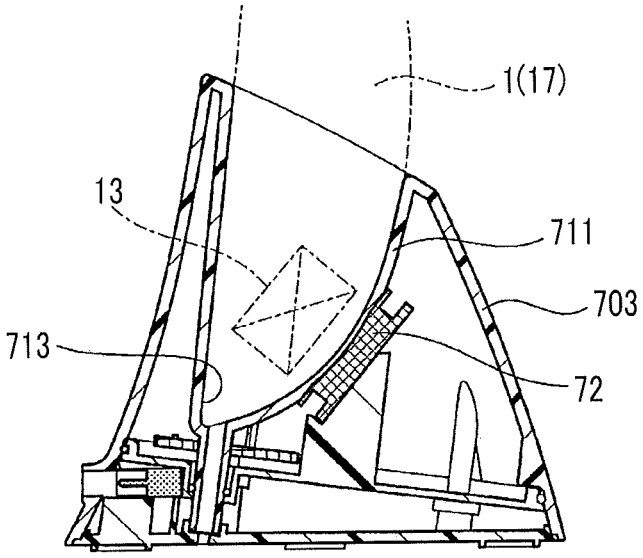
FIG. 21 is a cross-sectional view taken along a line XXI-XXI of FIG. 19.

This is an example in which the shape of the charging stand is changed. As illustrated in FIGS. 19 to 21, a charging stand 703 of this example has a recessed portion 713 configured to cover the entire circumference of the rear end portion 17 of the cosmetic device 1. A power transmission coil 72 is stored inside the charging stand 703. The power transmission coil 72 is disposed at a position at which it faces the power receiving coil portion 13 via the wall portion 711 of the charging stand 703 and the lower housing 21 (not illustrated) in a state in which the rear end portion 17 of the cosmetic device 1 is inserted in the recessed portion 71.

As in this example, by forming the shape of the recessed portion 713 to cover the entire circumference of the rear end portion 17 of the cosmetic device 1, the cosmetic device 1 inserted into the recessed portion 713 can be held more stably.

The cosmetic device is not limited to the aspects of the above-mentioned examples, and the configuration can be appropriately changed within the scope that does not impair its gist.

For example, in the above-described examples, an example in which the axial direction of the rotary shaft 42 of the vibration motor 4 and the extension direction of the brush attachment portion 6 are orthogonal to each other has been described, but the angle formed by the axial direction and the extension direction is not limited to 90°.

Further, the extension direction of the fibers in the brush portion 3 can be set to a direction different from the extension direction of the brush attachment portion 6.

The number or arrangement of the coupling portions 11 can be appropriately changed.

Also, as the coupling portion 11, an example of a configuration which includes the guide rod 24 and the ring-shaped elastic members 53 and 54 has been described. However, for example, it is possible to adopt the above-described snap fit structure or the like in place of this configuration. In this case, the coupling portion 11 can be formed by a simple operation of engaging the protruding portion with the recess portion. Therefore, the assembling operation of the cosmetic device 1 can be simplified.

The rotation restricting portion 622 provided in the brush attachment portion 6 may have a shape other than a hexagonal prism shape. Further, as the rotation restricting portion, it is possible to adopt a configuration that is capable of engaging the brush portion 3 with the brush attachment portion 6. For example, the rotation restricting portion may be a protrusion protruding outward from the tubular portion 61 or the shaft 62. By engaging this protrusion with the brush holder 32, the rotational motion of the brush portion 3 can be restricted.

It is also possible to omit the main body electrode 14 provided in the intermediate housing 22 and the brush electrode 325 provided in the brush holder 32.

Although a secondary battery is adopted as the power supply portion 122 of this example, a primary battery may be used in place of the secondary battery. In this case, the power receiving coil portion 13 can also be omitted.

Further, when a secondary battery is used as the power supply portion 122, a configuration in which a charging terminal is provided in the main body portion 2 to perform charging by wire may be adopted.

The invention claimed is:

1. A cosmetic device having a main body portion, and a brush portion disposed outside the main body portion, the cosmetic device comprising:

a vibration motor disposed in the main body portion and having a rotary shaft equipped with an eccentric weight;

a motor holding portion that holds the vibration motor;

a coupling portion disposed in the main body portion that connects the motor holding portion to the main body portion in a relatively displaceable state; and a brush attachment portion extending from the motor holding portion and connected to the brush portion, wherein the brush attachment portion extends in a direction different from an axial direction of the rotary shaft in the vibration motor, and the coupling portion has 1) an elastic member interposed between the main body portion and the motor holding portion and 2) a guide rod provided in one of the main body portion or the motor holding portion, and the elastic member held by the other portion, and the guide rod penetrates the elastic member.

2. The cosmetic device according to claim 1, wherein the brush attachment portion extends in a direction perpendicular to the axial direction of the rotary shaft in the vibration motor.

3. The cosmetic device according to claim 2, wherein the cosmetic device has a plurality of coupling portions.

4. The cosmetic device according to claim 1, wherein the cosmetic device has a plurality of coupling portions.

5. The cosmetic device according to claim 4, wherein some of the coupling portions among the plurality of coupling portions are disposed on one side in the axial direction of the rotary shaft with respect to the center of gravity of the vibration motor, and the remaining coupling portions are disposed on the other side thereof.

6. The cosmetic device according to claim 5, wherein the cosmetic device has three of the coupling portions.

7. The cosmetic device according to claim 4, wherein the cosmetic device has three of the coupling portions.

8. The cosmetic device according to claim 7, wherein two of the coupling portions among the three coupling portions are disposed on one side in the axial direction of the rotary shaft with respect to the center of gravity of the vibration motor, and the remaining one coupling portion is disposed on the other side thereof.

9. The cosmetic device according to claim 1, wherein the brush portion has a large number of fibers extending in an extension direction of the brush attachment portion.

10. The cosmetic device according to claim 1, wherein the brush attachment portion has a rotation restricting portion that restricts rotational motion of the brush portion centered on the brush attachment portion.

11. The cosmetic device according to claim 1, wherein the vibration motor is a cylinder type vibration motor.

12. The cosmetic device according to claim 1, wherein the brush portion includes a brush main body made of a plurality of fibers, a brush holder that holds the brush main body, and a brush electrode disposed on an outer surface of the brush holder, the main body portion has a current generating portion stored inside, and a main body electrode disposed on the outer surface, and the brush electrode and the main body electrode electrically connect to each other via the current generating portion.

13. The cosmetic device according to claims 1, wherein the main body portion has a rod shape, and the vibration motor and the motor holding portion are stored in an end portion of the main body portion in a longitudinal direction.

14. The cosmetic device according to claim 13, wherein the brush portion is disposed on a side peripheral surface of the main body portion.

15. A cosmetic device having a main body portion, and a brush portion disposed outside the main body portion, the cosmetic device comprising:

a vibration motor disposed in the main body portion and having a rotary shaft equipped with an eccentric weight;

a motor holding portion that holds the vibration motor;

a coupling portion disposed in the main body portion that connects the motor holding portion to the main body portion in a relatively displaceable state; and a brush attachment portion extending from the motor holding portion and connected to the brush portion, wherein the brush attachment portion extends in a direction different from an axial direction of the rotary shaft in the vibration motor, and a vibration direction of the vibration motor is a brush length direction.

16. The cosmetic device according to claim 15, wherein an angle between an extension direction of the brush attachment portion and an axial center direction of the rotary shaft is 80 to 110°.

* * * * *